US012551768B1

(12) United States Patent
Salvatore

(10) Patent No.: US 12,551,768 B1
(45) Date of Patent: Feb. 17, 2026

(54) NET CAPTURE RECREATIONAL FRAME

(71) Applicant: Luca Salvatore, Washington, DC (US)

(72) Inventor: Luca Salvatore, Washington, DC (US)

( * ) Notice: Subject to any disclaimer, the term of this patent is extended or adjusted under 35 U.S.C. 154(b) by 0 days.

(21) Appl. No.: 19/260,529

(22) Filed: Jul. 6, 2025

(51) Int. Cl.
*A63B 63/00* (2006.01)

(52) U.S. Cl.
CPC ..... *A63B 63/004* (2013.01); *A63B 2063/005* (2013.01)

(58) Field of Classification Search
CPC ..... A63B 63/004; A63B 2063/005
See application file for complete search history.

(56) References Cited

U.S. PATENT DOCUMENTS

| | | | | |
|---|---|---|---|---|
| 5,476,266 | A * | 12/1995 | Caruso | A63B 63/004 160/330 |
| 6,142,892 | A | 11/2000 | Dennis | |
| 6,383,096 | B1 | 5/2002 | Green | |
| D485,487 | S | 1/2004 | Bryant | |
| 6,846,253 | B1 | 1/2005 | Szwalek | |
| 7,241,235 | B2 | 7/2007 | Caruso | |
| D636,661 | S * | 4/2011 | Marmas | D8/395 |
| 8,096,903 | B1 | 1/2012 | Brown | |
| 9,180,353 | B2 * | 11/2015 | Chen | A63B 63/004 |
| 9,283,455 | B2 | 3/2016 | Nelson | |
| 2018/0340590 | A1 * | 11/2018 | Giugovaz | F16G 11/046 |

FOREIGN PATENT DOCUMENTS

| | | | |
|---|---|---|---|
| DE | 29501259 | U1 | 4/1995 |
| EP | 3626317 | B1 | 6/2021 |
| ES | 2255464 | B1 | 8/2007 |
| FR | 2388153 | A1 | 7/1980 |
| NL | 2030892 | B1 | 8/2023 |

OTHER PUBLICATIONS https://www.anthem-sports.com/kwik-goal-100-pk-tamper-resistant-soccer-net-clips-10b3401.html, [Kwik Goal 100/pk Tamper Resistant Soccer Net Clips, 10B3401, Accessed Jun. 6, 2025].

https://www.crankshooter.com/products/tournament-goal-with-hooks-available-in-5mm-or-6mm-white-net-ready-to-use-in-2-minutes-by-crankshooter-free-shipping?_pos=2&_sid=c90a0a160&_ss=r, New! Quick Clip™ Tournament Lacrosse Goal, With Quick Attach Netting, Attaches in 90 seconds, Includes 5mm or 6mm White Net, [Accessed Jul. 6, 2025].

https://www.forzagoal.com/push-and-twist-u-net-clips.html+product_colour-White+pack_size-Pack~of~40, FORZA "Push & Twist" Net Clips For Aluminium Goals [White | Pack of 40], [Accessed Jun. 6, 2025].

* cited by examiner

*Primary Examiner* — Jeffrey S Vanderveen
(74) *Attorney, Agent, or Firm* — American University Washington College of Law

(57) ABSTRACT

An apparatus may comprise a recreational frame and a plurality of spring-loaded gates. The spring-loaded gates may be disposed to the recreational frame. The spring loaded gates may be moveable between an open position and a closed position. The closed position may enclose a capture area at least partially bound by the recreational frame.

19 Claims, 11 Drawing Sheets

NET CAPTURE RECREATIONAL FRAME

BRIEF DESCRIPTION OF DRAWINGS

The accompanying drawings, which are incorporated in and form a part of the specification, illustrate embodiments of the present invention and, together with the description, serve to explain the principles of the invention.

DETAILED DESCRIPTION

Example embodiment(s) comprise a supporting recreational goal frame configured to allow a net to be installed and removed. The netting may undergo purposeful installation and removal through the use of gates integrated with a frame. A sports goal, such as a soccer goal, may include a pair of posts connected by a crossbar to form a sports goal frame. The enclosed area of the frame may be considered the mouth of the goal. Time, regular usage, and exposure to the elements may result in goal nets becoming unintentionally dislodged from the sports goal frame. This undesirable displacement may be the result of insufficient anchor devices and external forces. Existing approaches to net displacement have exhibited limitations with respect to usability, efficacy, and maintenance. Embodiments address these and other challenges.

Figure 1:
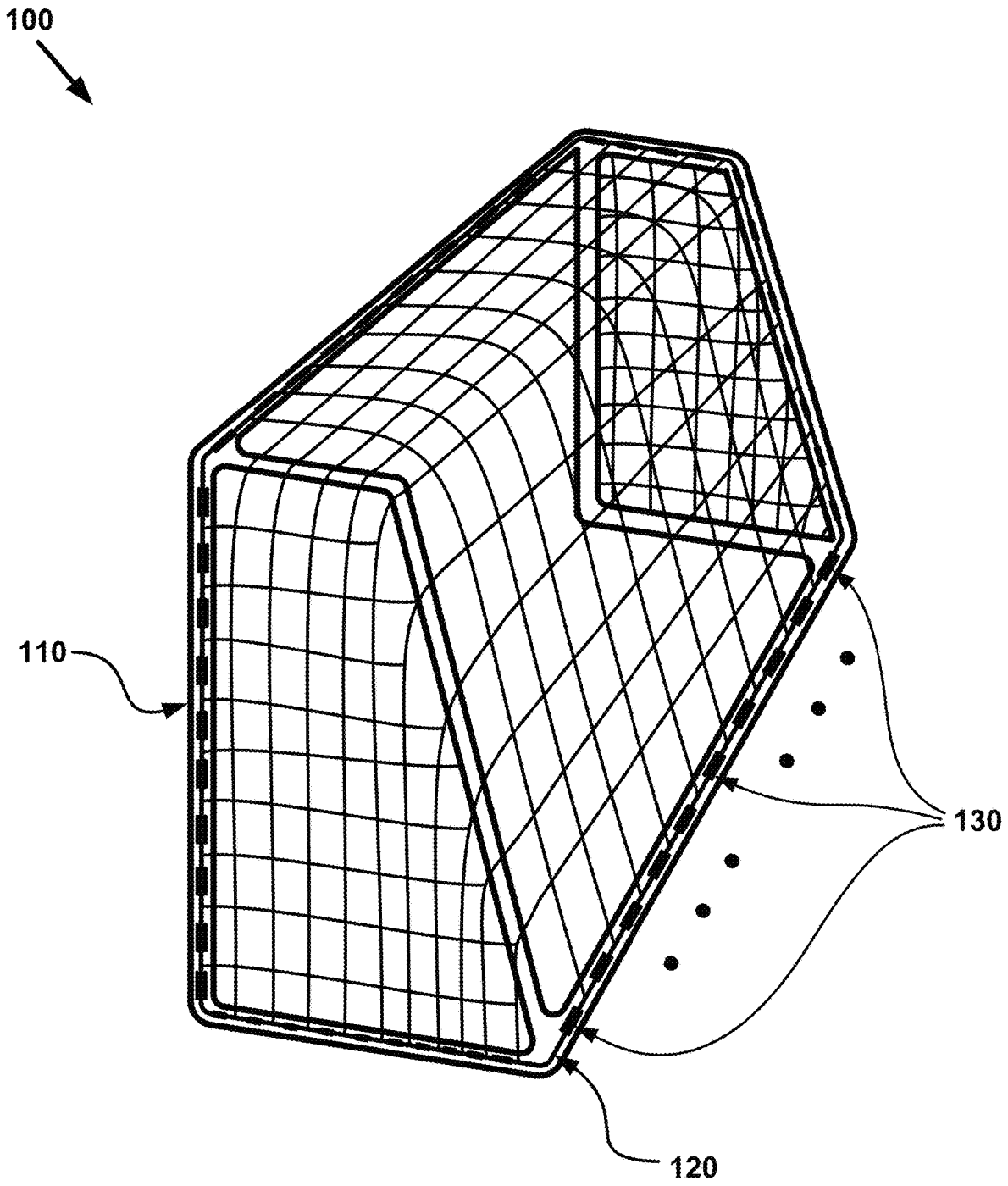
FIG. 1 shows a perspective view of an example embodiment of a net capture recreational frame.

FIG. 1 illustrates an example embodiment of a net capture recreational frame apparatus 100 that may comprise of a recreational frame 110 and a capture area 120 formed by spring-loaded gates 130. The spring-loaded gates 130 may be placed at intervals in relation to the form of the recreational frame 110 to permit the installation or removal of a sports net. The spring-loaded gates 130 may be positioned in relation to the form of the recreational frame 110 to permit the installation or removal of a sports net.

Figure 2:
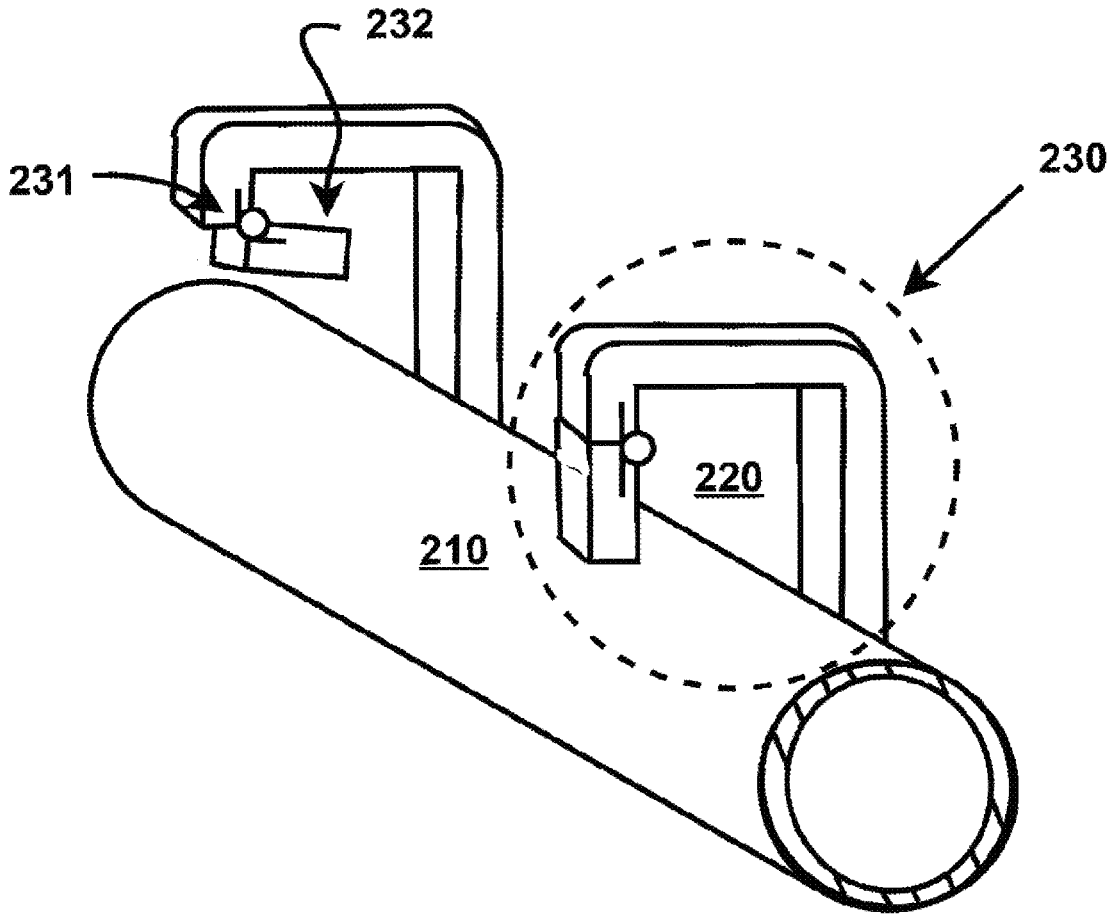
FIG. 2 is a perspective, cross-sectional view of an example embodiment of a net capture assembly.

FIG. 2 illustrates an example embodiment of a net capture recreational frame. A hollow recreational frame 210, and a plurality of spring-loaded gates 230 may protrude externally to create a capture area 220. As illustrated, the spring-loaded gates 230 may have different configurations dependent upon externally applied force upon the gate 232 compared to the oppositional force exerted by the spring 231. The springs 231 may be positioned relative to externally affixed arm of the spring-loaded gates 230. According to an example embodiment, a first end of the spring 231 may be positioned within the arm 233. According to an example embodiment, a first end of the spring 231 may be embedded in the arm 233. According to an example embodiment, a first end of the spring 231 may be attached to the arm 233. According to an example embodiment, a first end of the spring 231 may be welded to the arm 233. According to an example embodiment, a first end of the spring 231 may be bolted to the arm 233. According to an example embodiment, a first end of the spring 231 may be glued to the arm 233. According to an example embodiment, a first end of the spring 231 may be fastened to the arm 233. According to an example embodiment, a second end of the spring 231 may be positioned relative to the gate 232. According to an example embodiment, the configuration of the gate 232 may allow for an open position that permits the removal or installation of a sports net to or from the capture area 220. According to an example embodiment, the configuration of the gate 232 may allow for a closed position that restricts the mobility of a sports net to or from the capture area 220.

Figure 3:
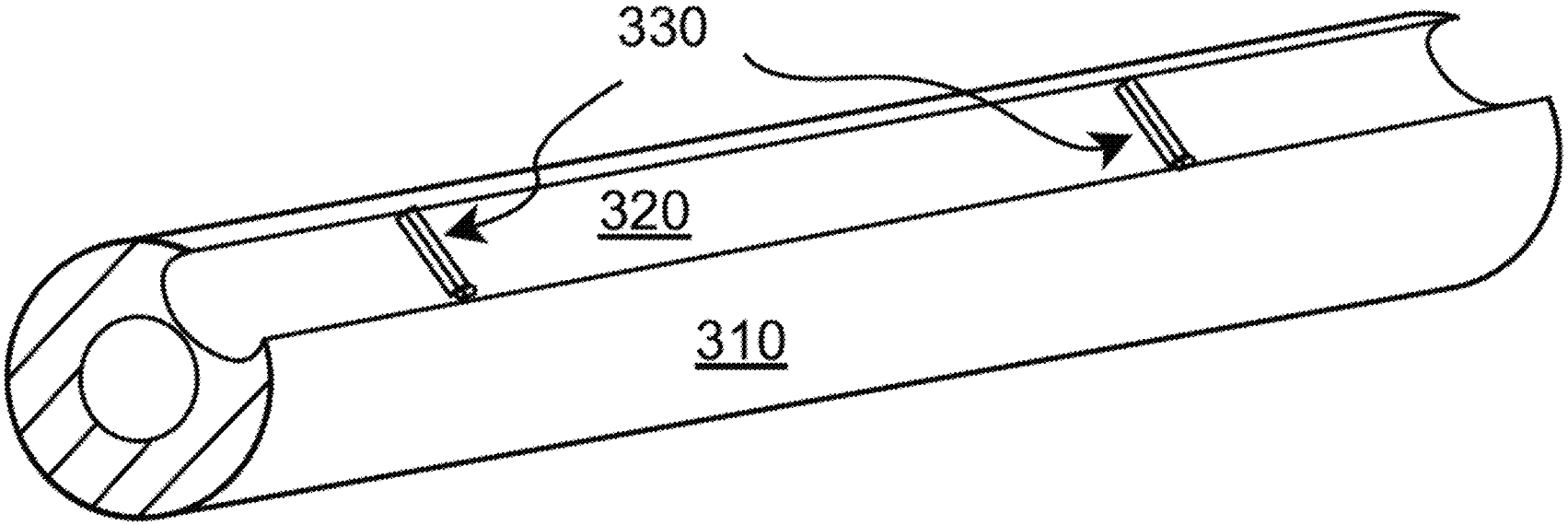
FIG. 3 is a is a perspective, cross-sectional view of an example embodiment of a net capture assembly.
Figure 4:
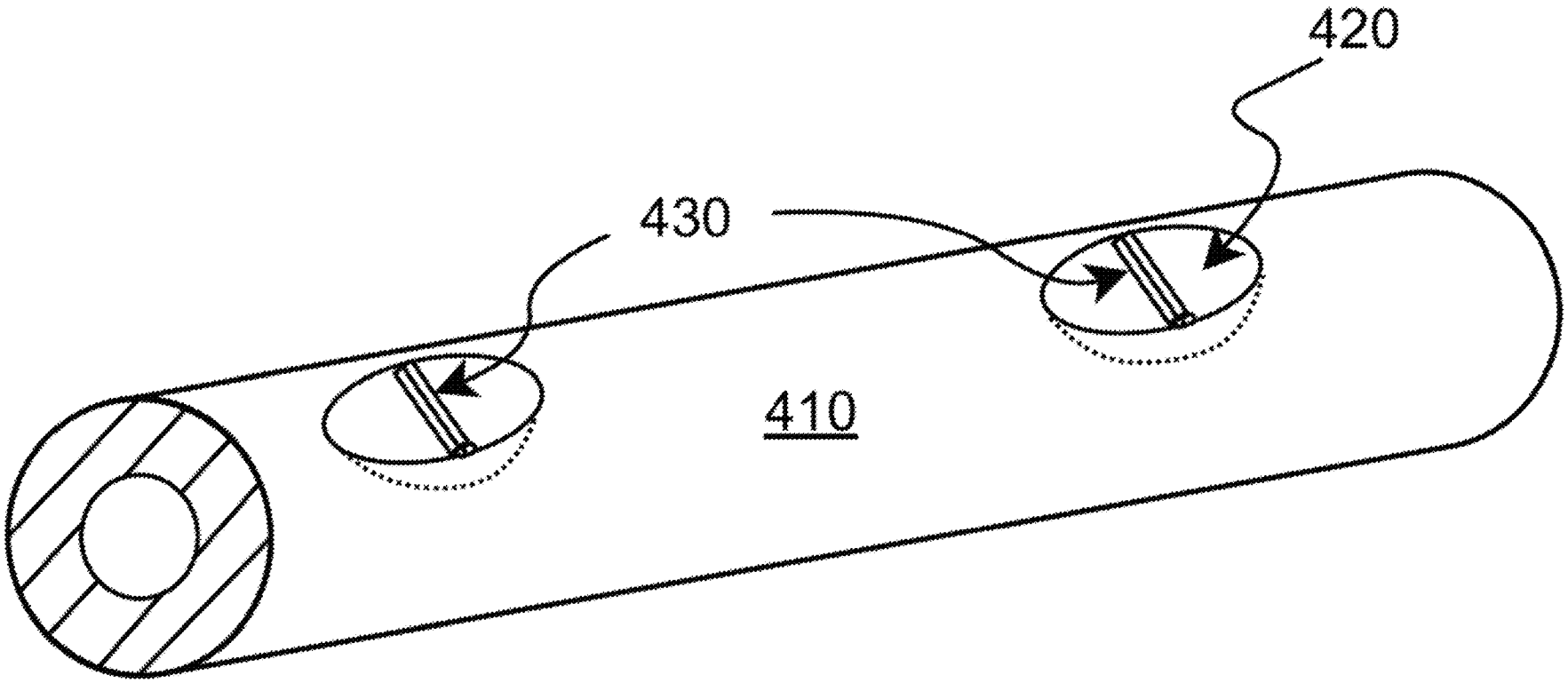
FIG. 4 is a is a perspective, cross-sectional view of an example embodiment of a net capture assembly.

Additional example embodiment are shown in FIGS. 3-4. In the illustrations, like components may be like-numbered. For example, 110, 210, and 310 are example embodiments of a recreational frame.

FIG. 3 is a is a perspective, cross-sectional view of an example embodiment of a net capture assembly. In this example embodiment, the capture area 320 may defined by a channel formed from a concavity within the hollow recreational frame 310 and spring-loaded gates 330. The spring-loaded gates 330 may not affix at the terminal end of a main body protrusion externally affixed to the recreational frame 310. The spring of the spring-loaded gate 330 may be affixed to the recreational frame 310. One terminal end of the spring may be embedded directly within the recreational frame 310 while the other end is embedded within the gate.

The arrangement illustrated in FIG. 4 comprises a capture area 420 that may be created by the spring-loaded gates' 430 traversal over divots (or concavities) spaced from one another at intervals along the perimeter of the recreational frame 410. The clearance between the spring-loaded gates 430 and the recreational frame 410 may be large enough for the gate 430 to pivot internally towards the center of the capture area 420 but small enough that it prevents the gate from pivoting externally away from the capture area 420 when the spring embedded within the gate and the recreational frame 410 may create such a net force to do so.

Figure 5:
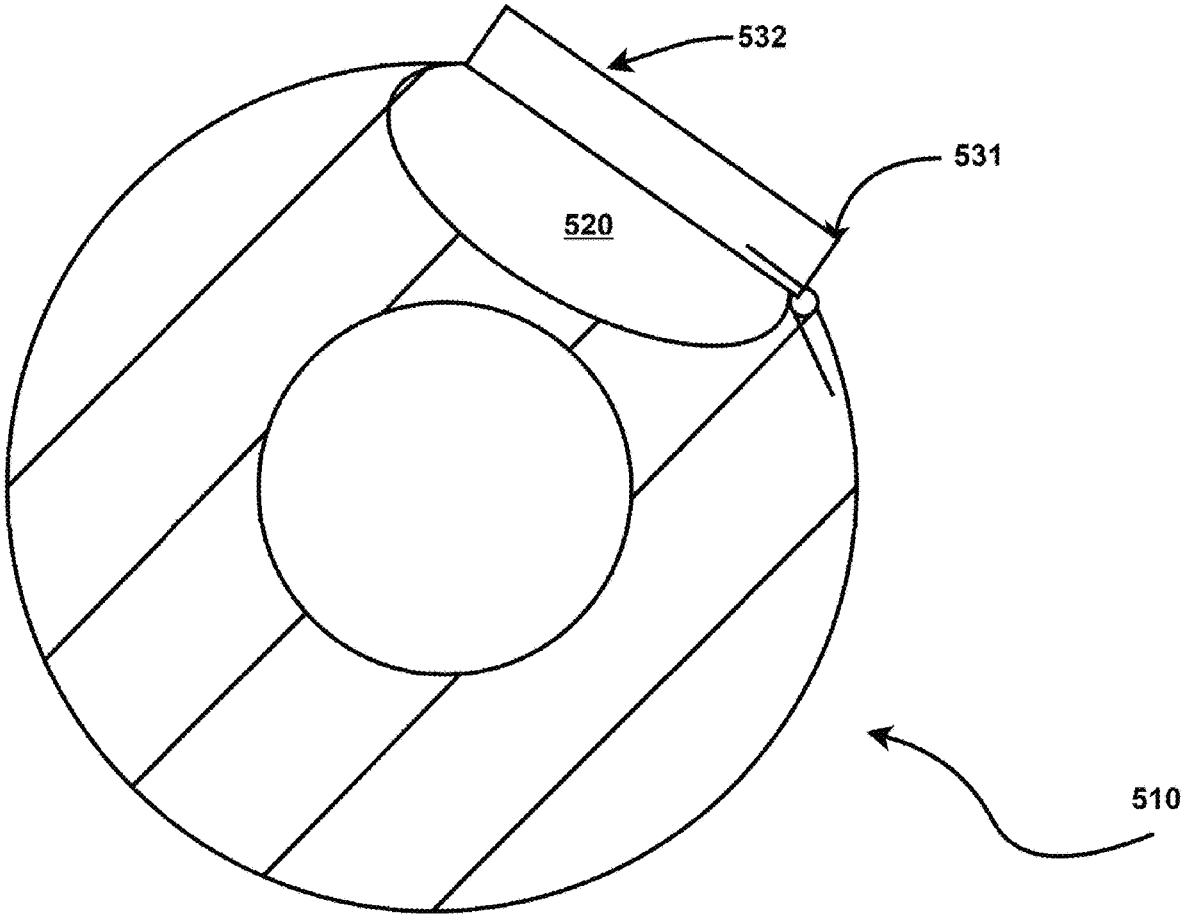
FIG. 5 is a cross-sectional view of an example embodiment of a net capture assembly.

FIG. 5 illustrates an example embodiment where a recreational frame 510 may have a single, continuous channel combined with spaced spring-loaded gates to form a capture area 520 along its perimeter. In an example embodiment, a spring-loaded gate 532, may rest in a closed configuration due to the spring 531 embedded within the recreational frame 510 and the gate 532. In this example, the spring 531 may exert a net force upon the gate 532 that pivots it externally from the capture area 520. This example configuration is one where the recreational frame and the gate come into physical contact to form a closed position.

Figure 6:
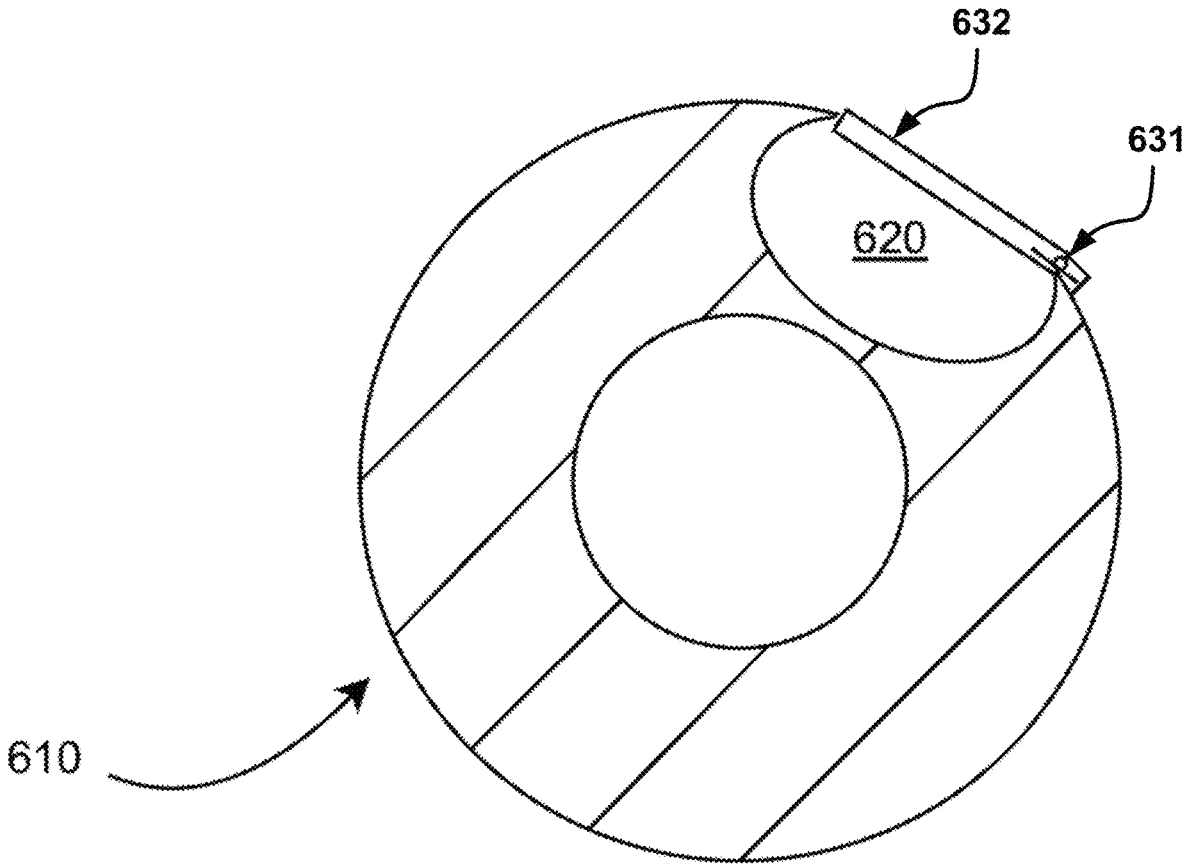
FIG. 6 is a cross-sectional view of an example embodiment of a net capture assembly.

The example embodiment illustrated in FIG. 6 comprises a spring-loaded gate that may be configured so that the spring 631 is embedded within and between the gate 632 and a protruding main body externally affixed to the recreational frame 610. The capture area 620 in this embodiment may not contain the gate 632 of the spring-loaded gate component to allow for the capture area 620 to possess a greater volume to contain a larger gauge net.

Figures 7A, 7B:
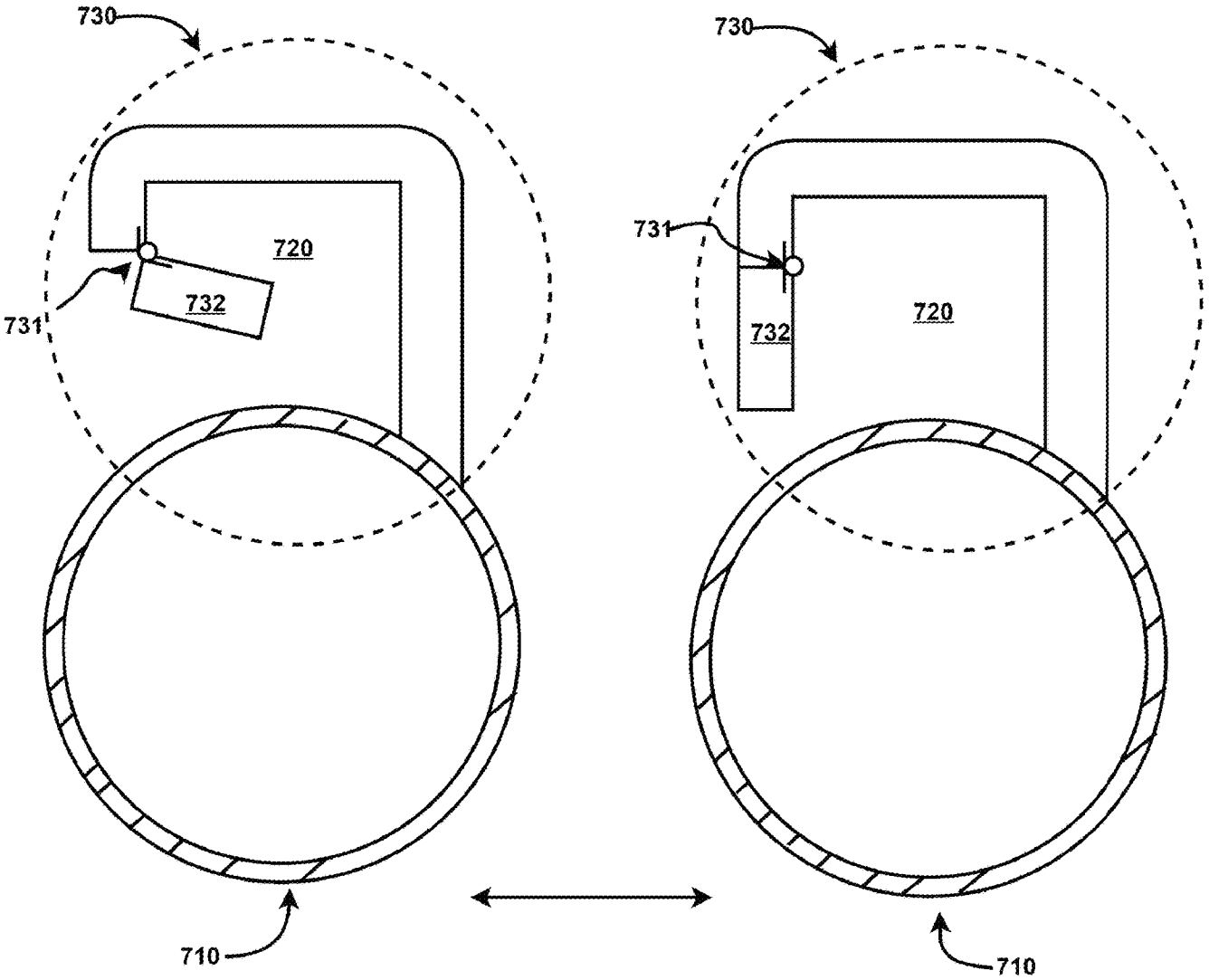
FIG. 7A and FIG. 7B are cross-sectional views showing two example configurations of a net capture assembly in an open and closed position as per aspects of an example embodiment.

FIG. 7A and FIG. 7B are cross-sectional views showing two example configurations of a net capture assembly in an open and closed position as per aspects of an example embodiment. Both of these illustrated example apparatuses include a recreational frame 710 with an externally affixed main body to suspend a spring-loaded gate 730, comprising a gate 732 and a spring 731, in opposition from the recreational frame 710 to form a capture area 720. A difference between these two example configurations are the positions of the spring 731 and gate 732 relative to the rest of the apparatus. In FIG. 7A the gate 732 and spring 731 intrude inwards into the capture area 720 against the spring's 731 force to form an open configuration and in FIG. 7B the gate 732 and spring 731 do not intrude inwards and instead form, in part, the perimeter of the capture area 720 along with the recreation frame 710.

Figures 8A, 8B:
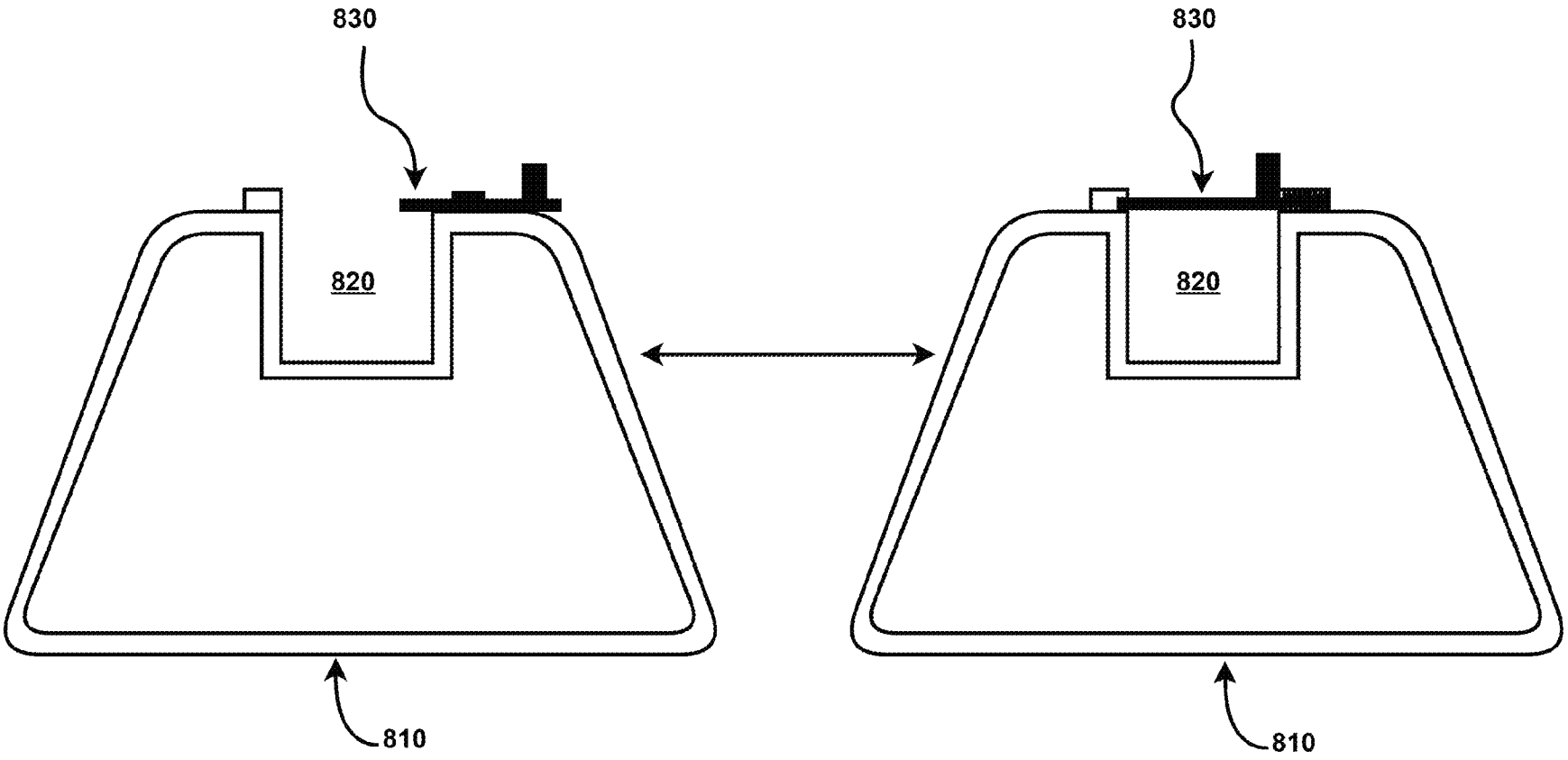
FIG. 8A and FIG. 8B are cross-sectional views showing two example configurations of a net capture assembly in an open and closed position as per aspects of an example embodiment.

FIG. 8A and FIG. 8B are cross-sectional views showing two example configurations of a net capture assembly in an open and closed position as per aspects of an example embodiment. Both of these illustrated example apparatuses include a recreational frame 810, a capture area 820, and a spring-loaded gate 830. The capture area's 820 perimeter may be defined in part by the perimeters of the spring-loaded gate and the recreational frame 810. The capture area 820 may additionally present along the entire length of the perimeter of the recreational frame 810 in the form of a channel. A difference between these two example configurations are the positions of the spring-loaded gates. In FIG. 8A, the spring-loaded gate 830 traverses across the channel capture area 820 to create a closed perimeter around the capture area. In FIG. 8B, the spring-loaded gate 830 is compressed against its component spring to break the capture area's 820 perimeter and form an open configuration. The open configuration may allow for the installation or removal of a sports net.

Additional arrangements of the net capture recreational frame embodiments are shown in FIGS. 9-11. These arrangements are distinct embodiments illustrating variations of the example embodiment of shown in FIG. 8 with like components being like-numbered.

Figures 9A, 9B:
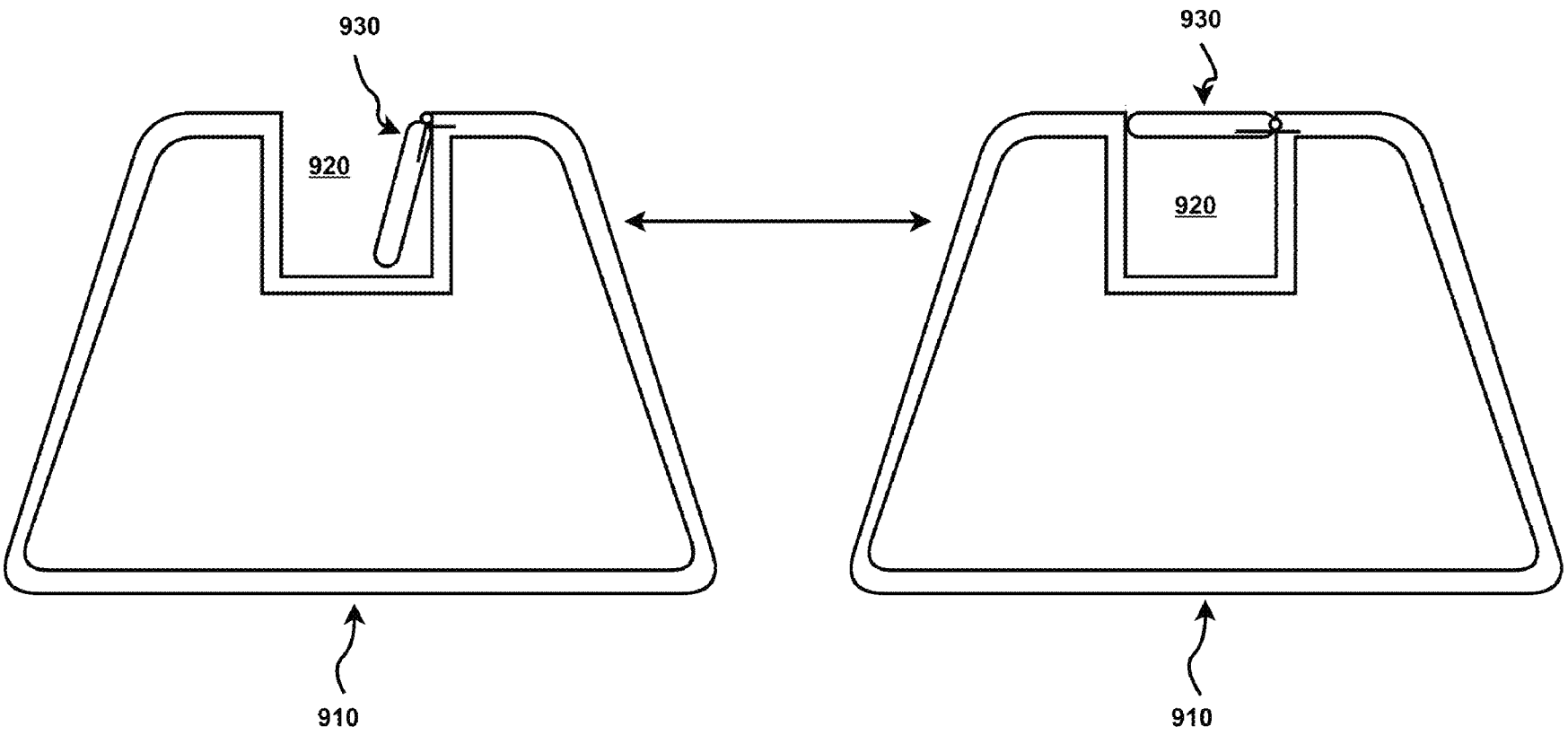
FIG. 9A and FIG. 9B are cross-sectional views showing two example configurations of a net capture assembly in an open and closed position as per aspects of an example embodiment.

In the example embodiment's arrangement illustrated in FIG. 9A and FIG. 9B, the spring-loaded gates 930 intrude pivotally inward to the capture area 920. Both these illustrated example include a recreational frame 910, a capture area 920, and a spring-loaded gate 930. A difference between these two example configurations are the positions of the spring-loaded gates relative to the rest of the apparatus. In the example embodiment illustrated in FIG. 9A, the spring-loaded gate 930 is pivotally rotated against the force of its component spring to intrude within the capture area 920. In the example embodiment illustrated in FIG. 9B, the spring-loaded gate 930 does not intrude within the capture area 920 and instead, in part, forms the capture area's 920 perimeter. FIG. 9A illustrates an open configuration and FIG. 9B illustrates a closed position of the apparatus as per aspects of an embodiment of the present invention.

Figures 10A, 10B:
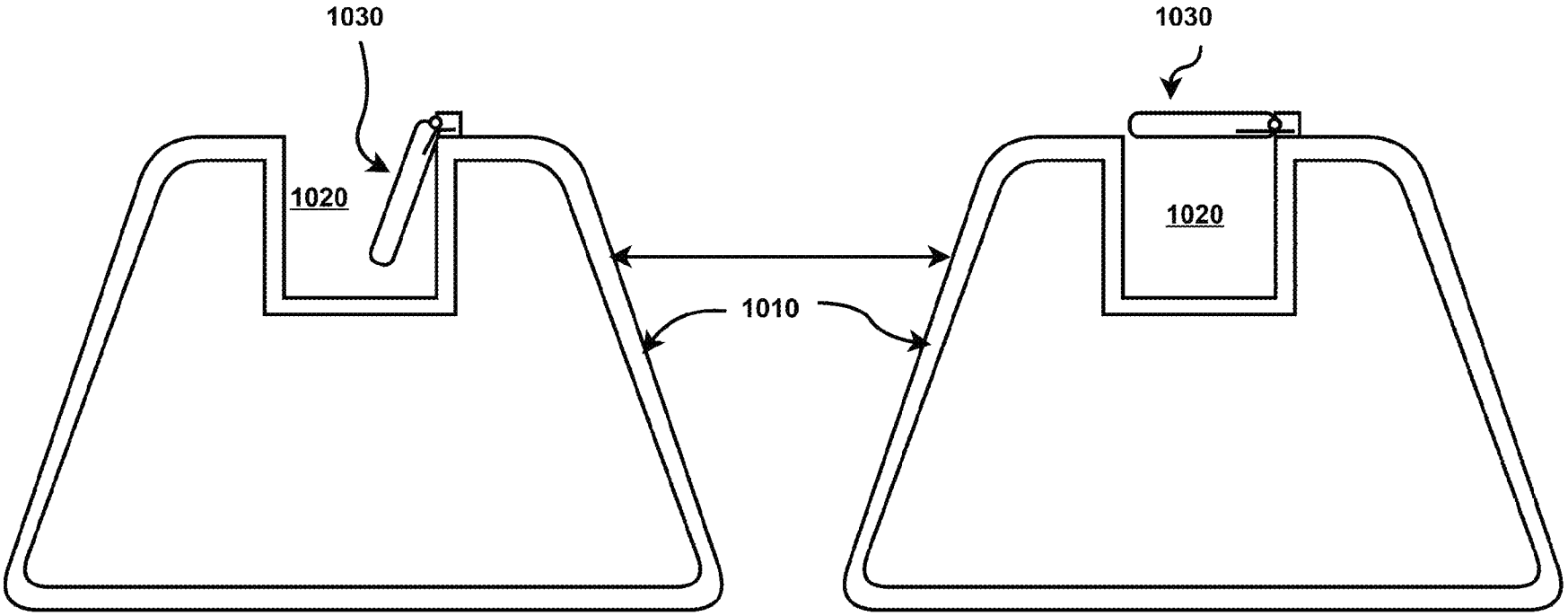
FIG. 10A and FIG. 10B are cross-sectional views showing two example configurations of a net capture assembly in an open and closed position as per aspects of an example embodiment.

In the example embodiments illustrated in FIG. 10A and FIG. 10B, the spring-loaded gates 1030 intrude pivotally inward to the capture area 1020 and their springs may be embedded within an externally affixed protrusion on the recreational frame. Both these illustrated example apparatuses include a recreational frame 1010, a capture area 1020, and a spring-loaded gate 1030. A difference between these two example configurations are the positions of the spring-loaded gates relative to the rest of the apparatus; in FIG. 10A the spring-loaded gate 1030 is pivotally rotated against the force of its component spring to intrude within the capture area 1020 and in FIG. 10B the spring-loaded gate 1030 does not intrude within the capture area 1020 and instead, in part, forms the capture area's 1020 perimeter. FIG. 10A illustrates an open configuration and FIG. 10B illustrates a closed position of the apparatus as per aspects of an embodiment of the present invention.

Figures 11A, 11B:
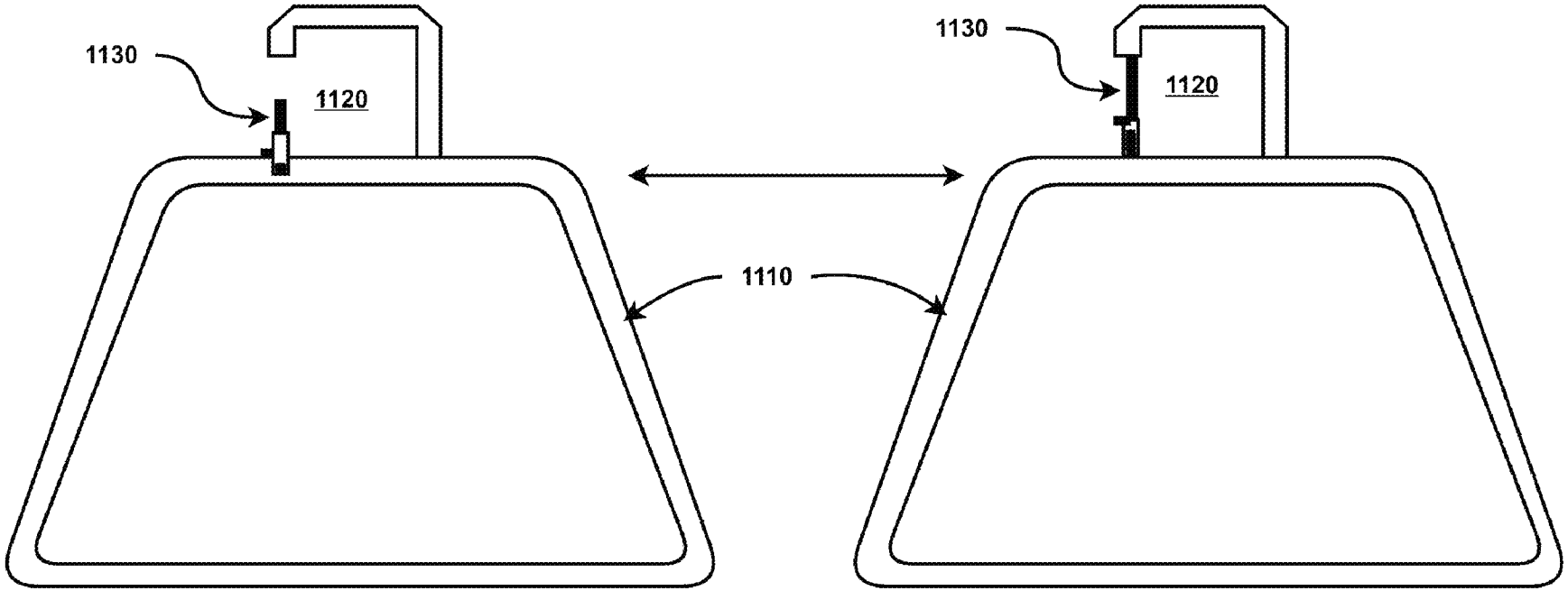
FIG. 11A and FIG. 11B are cross-sectional views showing two example configurations of a net capture assembly in an open and closed position as per aspects of an example embodiment.

FIG. 11 and FIG. 11B are cross-sectional views showing two example configurations of a net capture assembly in an open and closed position as per aspects of an example embodiment. In these examples, the spring-loaded gates 1130 may move laterally in a single direction, their springs are positioned perpendicularly along the recreational frame 1110, an extrusion from the recreational frame 1110, in part, defines the perimeter of the capture area 1120, and the spring-loaded gate 1130 may not be permanently affixed to the terminal end of the extrusion. Both of these illustrated example apparatuses include a recreational frame 1110, a capture area 1120, and a spring-loaded gate 1130. A difference between these two example configurations are the positions of the spring-loaded gates relative to the rest of the apparatus; in FIG. 11A the spring-loaded gate 1130 is vertically compressed against the force of its component spring to create a break in the perimeter of the capture area 1120 and in FIG. 11B the spring-loaded gate 1130 is not vertically compressed against the force of its component spring and, in part, defines the perimeter of the capture area 1120. FIG. 11A illustrates an open configuration and FIG. 11B illustrates a closed position of the apparatus as per aspects of an embodiment of the present invention.

The present disclosure relates generally to the field of recreational frames for supporting various types of netting and other textiles. Specific embodiments related to recreational sports goal frames are disclosed to teach the basic concept of recreational frames and accompanying netting. However, the concepts disclosed may be broader and may be applied to various other recreational frames such as (but not limited to): batting cages, hockey goals, lacrosse goals, field hockey goals, water polo goals, basketball rims, rebounding frames, trampolines, tennis net supports, catamaran netting supports, and other unnamed embodiments.

According to an example embodiment, the apparatus may comprise a recreational frame 110. According to an example embodiment, the recreational frame 110 may support a plurality of spring-loaded gates 130 disposed to the recreational frame 110. According to an example embodiment, the recreational frame 110 may provide foundation for a plurality of spring-loaded gates 130 disposed to the recreational frame 110. According to an example embodiment, the recreational frame 110 may have affixed a plurality of spring-loaded gates 130 disposed to the recreational frame 110. According to an example embodiment, the recreational frame 110 may provide the base for a plurality of spring-loaded gates 130 disposed to the recreational frame 110. According to an example embodiment, some portion of the recreational frame 110 may partially enclose a capture area 220.

A frame may be a structural system that supports other components of a physical construction. A frame may be a rigid structure that surrounds or encloses something. A frame may be something composed of parts fitted together and united. A frame may be the underlying constructional system or structure that gives shape or strength. A frame may be an open structure made for admitting, closing, or supporting something. A frame may be an enclosing border. A frame may be a skeleton of a structure. A frame may be a structure that forms the backbone on which other parts are mounted. A frame may be a structural component which supports the functional components of an apparatus. A frame may be the load-resisting sub-system of an object. A frame may be interconnected elements or members. A frame may consist of some combination of any or more of the following: tensile structures, compressive structures, trusses, shear structures, and bending structures. A frame may be an exoskeleton.

According to an example embodiment, a plurality of spring-loaded gates 130 may be disposed to the recreational frame 110. According to an example embodiment, the plurality of spring-loaded gates 130 may be greater than one spring-loaded gate. According to an example embodiment, the plurality of spring-loaded gates 130 may be disposed to the back of the recreational frame 110. According to an example embodiment, the plurality of spring-loaded gates 130 may be disposed on the sides of the recreational frame 110. According to an example embodiment, the plurality of spring-loaded gates 130 may be disposed to the front of the recreational frame 110. According to an example embodiment, the plurality of spring-loaded gates 130 may be disposed along the inside of the recreational frame 110. According to an example embodiment, the plurality of spring-loaded gates 130 may be disposed along the outside of the recreational frame 110. According to an example embodiment, the plurality of spring-loaded gates 130 may be configured to evenly secure a net to the recreational frame 110. According to an example embodiment, the plurality of spring-loaded gates 130 may be configured to evenly secure a woven textile to the recreational frame 110. According to an example embodiment, the plurality of spring-loaded gates 130 may be covered by a protective sleeve.

A spring-loaded gate may comprise a clip used to quickly and reversibly connect components. A spring-loaded gate may comprise a solid gate with separate pin and spring mechanisms. A spring-loaded gate may comprise a wire gate formed from a single piece of bent spring material. A spring-loaded gate may comprise manually locked or auto-locking. A spring-loaded gate may be fashioned as a carabiner. A spring-loaded gate may comprise a bolt snap hook. A spring-loaded gate may comprise a slide gate. A spring-loaded gate may comprise a spring-loaded rod which slides longitudinally inside the body of a clip against a compression spring to open the gate of a hook. A spring-loaded gate may comprise a lobster clasp. A spring-loaded gate may comprise a fastener that is held closed by a spring. A spring-loaded gate may be opened or closed by actuating a lever, after which it is attached to or removed from a short link-chain or a ring-like structure.

A plurality may describe the fact or state of being plural. A plurality may describe a large number of components or things. A plurality may be used to describe more than one object. A plurality may describe two or more of a thing.

According to an example embodiment, a plurality of spring-loaded gates 130 may be moveable between an open and closed position. According to an example embodiment, each spring-loaded gate 130 may partially enclose a capture area 220. According to an example embodiment, each spring-loaded gate 130 may pivot around a point. According to an example embodiment, each spring-loaded gate 130 may slide parallel to the recreational frame 110. According to an example embodiment, each spring-loaded gate 130 may rest in a closed position. According to an example embodiment, each spring-loaded gate 130 may latch in a closed position. According to an example embodiment, each spring-loaded gate 130 may lock in a closed position. According to an example embodiment, each spring-loaded gate 130 may be configured to move from a closed position to an open position.

According to an example embodiment, a capture area 220 may be configured so that its perimeter may be comprised of, in part, some portion of the spring-loaded gate 130 and some portion of the recreational frame 110. According to an example embodiment, a capture area 220 may be configured so that its perimeter may be comprised of, in part, some portion of the spring-loaded gate 130 or some portion of the recreational frame 110. According to an example embodiment, a capture area may be outside of the recreational frame 110. According to an example embodiment, the capture area may be inside of the recreational frame 110. According to an example embodiment, the capture may be configured to secure a net to the recreational frame 110. According to an example embodiment, the capture area may be configured to secure a woven textile to the recreational frame 110.

A capture area may comprise a clearly marked space with set boundaries. A capture area may comprise an area restricted by predetermined borders. A capture area may comprise a space surrounded by a barrier or limit. A capture area may comprise a channel. A capture area may comprise a gap. A capture area may comprise a gated compound. A capture area may comprise an enclosed area with controlled entry points. A capture area may comprise a secured area with physical or virtual barriers. A capture area may comprise an area with controlled or limited movement. A capture area may comprise a hollow enclosure. A capture area may comprise a space within a surrounding structure. A capture area may comprise the open section within a curved or looped structure. A capture area may comprise an empty area within a frame or structure. A capture area may comprise the enclosed portion within a structure. A capture area may comprise a designated area designed to hold objects. A capture area may comprise a space where something can enter or be captured.

An open position may describe when a mechanism is disengaged. An open position may describe when a mechanism allows entry, movement, or passage of a component. An open position may describe a state where a gate or barrier is not in contact with the securing mechanism and forms a gap between components. An open position may describe a hinge or latch in a position where movement or access is unrestricted. An open position may describe a gate not in contact with a frame. An open position may allow objects to enter or exit an otherwise enclosed space.

A closed position may describe when a mechanism is engaged. A closed position may prevent entry, movement, or passage of another component. A closed position may describe a state where a gate or barrier is fully in place. A closed position may describe a component that secures an enclosed space. A closed position may describe a state of being where access to a component or space is restricted or obstructed. A close position may describe a hinge or latch in a locked position. A closed position may describe a hinge or latch in contact with a restrictive mechanism or component. A closed position may describe a gate in full contact with a frame. A closed position may describe a gate that prevents objects from entering or exiting.

In this disclosure, "a" and "an" and similar phrases are to be interpreted as "at least one" or "one or more." Similarly, any term that ends with the suffix "(s)" is to be interpreted as "at least one" or "one or more." In this disclosure, the term "may" is to be interpreted as "may, for example." In other words, the term "may" is indicative that the phrase following the term "may" is an example of one of a multitude of suitable possibilities that may, or may not, be employed to one or more of the various embodiments. The phrase "based on" is indicative that the phrase following the term "based on" is an example of one of a multitude of suitable possibilities that may, or may not, be employed to one or more of the various embodiments. The phrase "in response to" is indicative that the phrase following the phrase "in response to" is an example of one of a multitude of suitable possibilities that may, or may not, be employed to one or more of the various embodiments. The terms "including" and "comprising" may be interpreted as meaning "including, but not limited to." In this disclosure, the abbreviation "e.g." means "for example" and is followed by one or more examples that illustrate a term receding the abbreviation.

In this disclosure and the claims, differentiating terms like "first," "second," "third," identify separate elements without implying an ordering of the elements or functionality of the elements. Differentiating terms may be replaced with other differentiating terms when describing an embodiment.

In this disclosure, various embodiments are disclosed. Limitations, features, and/or elements from the disclosed example embodiments may be combined to create further embodiments within the scope of the disclosure.

Many features presented above are described as being optional through the use of "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

While various embodiments have been described above, it should be understood that they have been presented by way of example, and not limitation. It will be apparent to persons skilled in the relevant art(s) that various changes in form and detail can be made therein without departing from the scope. In fact, after reading the above description, it will be apparent to one skilled in the relevant art(s) how to implement alternative embodiments. Thus, the present embodiments should not be limited by any of the above described example embodiments. In particular, it should be noted that, for example purposes, the above explanation has focused on a recreational sports goal frame for the purpose of securing a sports net. However, one skilled in the art will recognize that embodiments of the invention may also be implemented in other applications such as securing a fishing net, securing a trampoline, securing a hammock, securing a banner, combinations thereof, and/or the like.

In addition, it should be understood that any figures which highlight the functionality and advantages, are presented for example purposes only. Disclosed examples are sufficiently flexible and configurable, such that it may be utilized in ways other than that shown. For example, the actions listed in any flowchart may be re-ordered or only optionally used in some embodiments.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Finally, it is the applicant's intent that only claims that include the express language "means for" or "step for" be interpreted under 35 U.S.C. 112. Claims that do not expressly include the phrase "means for" or "step for" are not to be interpreted under 35 U.S.C. 112.

The invention claimed is:

1. An apparatus, comprising:
a recreational frame;
a plurality of spring-loaded gates each:
disposed to the recreational frame;
moveable between:
an open position; and
a closed position enclosing a capture area at least partially bound by the recreational frame; and
wherein each of the plurality of spring-loaded gates comprise a spring positioned to hold the gate in the closed position with a sufficient force to prevent unintentional movement into the open position.

2. The apparatus of claim 1, wherein each of the plurality of spring-loaded gates is disposed to the recreational frame via an external arm.

3. The apparatus of claim 1, wherein the sufficient force allows a sports net to be captured and removed from the capture area.

4. The apparatus of claim 1, wherein the frame body is configured in the shape of a sports goal.

5. The apparatus of claim 1, wherein the frame body is configured in the shape of a soccer goal.

6. The apparatus of claim 1, wherein there are a number of clip structures disposed along the frame.

7. The apparatus of claim 1, wherein at least one of the plurality of spring-loaded gates is configured to substantially enclose the capture area in combination with the frame body.

8. The apparatus of claim 1, wherein at least one of the plurality of spring-loaded gates is affixed to the frame.

9. The apparatus of claim 1, wherein at least one of the plurality of spring-loaded gates is configured to be pivotally attached to the frame.

10. The apparatus of claim 1, wherein at least one of the plurality of spring-loaded gates is configured to be under tension against pivotal rotation inward.

11. The apparatus of claim 1, wherein at least one of the plurality of spring-loaded gates is configured to be under tension against translation parallel to the spring force.

12. The apparatus of claim 1, wherein at least one of the plurality of spring-loaded gates is configured to substantially enclose the capture area.

13. The apparatus of claim 1, wherein at least one of the plurality of spring-loaded gates is configured to be pivotally rotated into the capture area when subjected to an external inward force.

14. The apparatus of claim 1, wherein at least one of the plurality of spring-loaded gates is configured to allow for the width of a net to pass into the capture area.

15. The apparatus of claim 1, wherein at least one of the plurality of spring-loaded gates is configured to open the capture area.

16. The apparatus of claim 1, wherein at least one of the plurality of spring-loaded gates is loaded with sufficient force to prevent unintentional removal of the net from the capture area.

17. The apparatus of claim 1, wherein some combination of the frame body, and at least one of the plurality of spring-loaded gates is create a capture area.

18. The apparatus of claim 1, wherein the capture area is configured to contain an edge of a net or rope.

19. The apparatus of claim 1, wherein the capture area exists within the frame body.

* * * * *